US008402883B2

(12) United States Patent
Kollep et al.

(10) Patent No.: US 8,402,883 B2
(45) Date of Patent: Mar. 26, 2013

(54) CAPSULE WITH DELAMINATABLE INJECTION MEANS

(75) Inventors: Alexandre Kollep, Lutry (CH); Christophe S. Boussemart, Lugrin (FR)

(73) Assignee: Nestec S.A., Vevey (CH)

( * ) Notice: Subject to any disclaimer, the term of this patent is extended or adjusted under 35 U.S.C. 154(b) by 559 days.

(21) Appl. No.: 12/689,896

(22) Filed: Jan. 19, 2010

(65) Prior Publication Data

US 2010/0180775 A1 Jul. 22, 2010

(30) Foreign Application Priority Data

Jan. 22, 2009 (EP) ..... 09151149

(51) Int. Cl.
*A47J 31/00* (2006.01)
*B65B 29/02* (2006.01)
*B65D 85/00* (2006.01)

(52) U.S. Cl. ..... 99/295; 99/323; 426/77

(58) Field of Classification Search ..... 99/295, 99/289 R, 302 R, 323; 426/77, 78, 80, 82, 426/433; 53/452, 454, 464, 476, 477, 485, 53/488, 489
See application file for complete search history.

(56) References Cited

U.S. PATENT DOCUMENTS

| | | | | |
|---|---|---|---|---|
| 3,610,461 | A * | 10/1971 | Allyn | 220/212 |
| 4,921,712 | A * | 5/1990 | Malmquist | 464/77 |
| 5,402,707 | A | 4/1995 | Fond et al. | 99/295 |
| 6,810,788 | B2 * | 11/2004 | Hale | 99/295 |
| 6,948,420 | B2 * | 9/2005 | Kirschner et al. | 99/295 |
| 7,543,527 | B2 * | 6/2009 | Schmed | 99/295 |
| 7,552,672 | B2 | 6/2009 | Schmed | 99/295 |
| 7,604,826 | B2 | 10/2009 | Denisart et al. | 426/77 |
| 7,981,451 | B2 | 7/2011 | Ozanne | 426/79 |
| 2005/0150390 | A1 | 7/2005 | Schifferle | 99/295 |
| 2007/0181003 | A1 | 8/2007 | Bardazzi | 99/279 |
| 2009/0047389 | A1 | 2/2009 | Jarisch et al. | 426/80 |
| 2010/0313766 | A1 | 12/2010 | Suggi Liverani et al. | 99/295 |
| 2011/0030563 | A9 | 2/2011 | Doglioni Majer | 99/295 |
| 2011/0045144 | A1 * | 2/2011 | Boussemart et al. | 426/80 |

FOREIGN PATENT DOCUMENTS

| | | |
|---|---|---|
| DE | 20 2005 021160 | 5/2007 |
| DE | 10 2007 024579 | 11/2008 |
| EP | 0 512 470 | 11/1992 |
| EP | 1 165 398 | 1/2002 |
| EP | 1 190 959 | 3/2002 |
| EP | 1 604 915 | 12/2005 |
| EP | 1 834 899 | 9/2007 |
| EP | 1 847 481 | 10/2007 |
| WO | WO 94/02059 | 2/1994 |
| WO | WO 95/09775 | 4/1995 |

(Continued)

OTHER PUBLICATIONS

European Search Report, EP 09 15 1149.3, mailed Jun. 8, 2009.

(Continued)

*Primary Examiner* — Reginald L Alexander
(74) *Attorney, Agent, or Firm* — Winston & Strawn LLP

(57) ABSTRACT

The present invention proposes a capsule for containing beverage ingredients comprising a sealed ingredient compartment, an inlet face, an outlet face, an aperture in the inlet face of the capsule, a membrane attached to the inner side of the portion of the inlet face surrounding the aperture, wherein the membrane is attached to the inlet face by a first circumferential section in a detachable sealing engagement.

19 Claims, 5 Drawing Sheets

FOREIGN PATENT DOCUMENTS

Figure 1A:
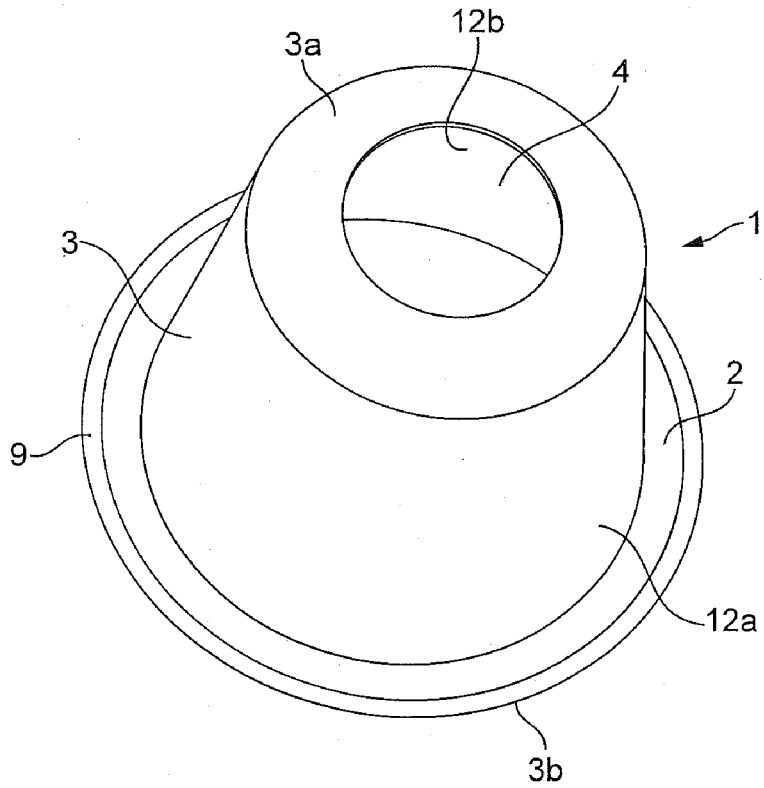

| | | |
|---|---|---|
| WO | WO 2005/020768 | 3/2005 |
| WO | WO 2005/090196 | 9/2005 |
| WO | WO 2006/030461 | 3/2006 |
| WO | WO 2009/006374 | 1/2009 |

OTHER PUBLICATIONS

European Search Report, EP 09 15 1060.2, mailed Jul. 23, 2009.

* cited by examiner

CAPSULE WITH DELAMINATABLE INJECTION MEANS

FIELD OF THE INVENTION

The present invention relates to the field of closed capsules for preparing beverages in a beverage preparation device. In particular, the present invention relates to a sealed capsule comprising a membrane being attached to an aperture of the capsule in a selectively detachable sealing engagement.

BACKGROUND OF THE INVENTION

The background of the present invention is the field capsules which contain beverage or other comestibles (e.g. soup) ingredients. By means of an interaction of these ingredients with a liquid, a beverage or other comestible can be produced. The interaction can be for example an extraction, brewing or dissolution process. Such a capsule is particularly adapted to contain ground coffee in order to produce a coffee beverage by injecting hot water under pressure into the capsule and gaining a coffee beverage from the capsule.

Systems and methods for obtaining fluid comestibles from substances containing capsules are for example known from EP 512 470 A (Counterpart of U.S. Pat. No. 5,402,707).

The principle of this extraction process as far as it can be maintained in connection with the present invention can be summarized as follows.

An initially sealed capsule is inserted in a dedicated extraction chamber of the system in which water injection means are provided which enable a provision of water to the extraction chamber, e.g., by injection. In the extraction chamber, dedicated opening means are provided which generate at least one opening in a first wall of the capsule. Accordingly, water entering the capsule through the opening in the first wall is made to interact with ingredients contained in the capsule while traversing the interior of the capsule and is then made to leave the capsule through at least one opening/perforation created in a second wall of the capsule. As a result of the interaction, a beverage or other comestible will be produced which can be obtained directly from the capsule.

EP 870 457 A1 and WO 94/02059 show extraction methods and extraction machines for essentially symmetrical capsule.

It is important that the capsule is gas-tightly closed before use to ensure the freshness of the ingredients within a given shelf life.

Therefore, preferred capsules are closed by impermeable walls which are pierced only during use, such as by introduction of the capsule in the device.

However, the known capsules and the known beverage preparation devices suffer several drawbacks.

It is for example difficult that piercing of certain capsules is realized in a repeated manner. Especially, in combination with capsules made from plastics, the material can be relatively hard to pierce and the piercing members can become blunt relatively rapidly. As a result, new capsules can no longer be pierced with the same device and hence, a repairing or replacing of the piercing elements or the piercing member of the device becomes necessary.

Moreover, the piercing member of the device provides a single injection pattern in the capsule. It is thus not possible to vary the manner the liquid is injected into the capsule, such as the number of holes, the direction of injection, the depth of injection etc., unless a complicated injection commuting system as described in WO 2005/020768 is provided. However, such devices are complex and costly to produce.

Another problem is that when the capsule is removed from the device, the piercing member disengages from the capsule at the same time. As a result, large holes are typically left in the capsule, which provide a potential source of leakage for beverage residua such a coffee solids. A solutions exists which consists in adding an internal filter to prevent the exit of such residua such as in EP 1 165 398.

Another problem is that the piercing member comes in contact with the ingredients when puncturing or piercing the capsule. For certain ingredients, such as infant formula it is necessary to clean or sanitize the piercing member after each preparation cycle such as described in PCT/EP2008/057979.

WO 2006/030461 relates to a capsule which comprises a piercing element turned upwards in direction of an outer membrane. Piercing of the injection holes is obtained by the pressure of fluid which presses the membrane against the sharp elements. This solution, however, has several disadvantages. In particular, the membrane is easily able to be pierced by accident. Hence, if the user manipulates too much at the capsule, the membrane will be pierced before use, which causes rapid degradation of the ingredients. Moreover, the sharp edges being protruding into the direction of the user constitute a possible source of risk, since the user may sting himself. Moreover, resurgence of liquid or solids from the capsule is prevented in case the pressure within a receiving chamber and thus in the capsule is reduced after injection of liquid during operation of the device, as the membrane remains opened with the holes being uncovered.

The present invention therefore seeks to address the above-described problems. Moreover, the present invention aims at providing a solution to other problems as will appear in the rest of the description.

SUMMARY OF THE INVENTION

The present invention proposes a capsule for making a beverage and comprising a sealed ingredients compartment containing beverage ingredients, an inlet face and an outlet face. The capsule furthermore comprises an aperture in the inlet face of the capsule, and a membrane attached to the inner side of the portion of the inlet face surrounding the aperture, wherein the membrane is attached to the inlet face by a first circumferential section in a detachable sealing engagement.

The inlet face generally has outer and inner sides and is dedicated for injection of liquid into the capsule to form a beverage from the beverage ingredients. According to the present invention, the detachable sealing engagement of the membrane and the inner side of the portion of the inlet face surrounding the aperture can be delaminated by a certain predefined pressure or force being exerted on the membrane. Therefore, a reliable opening mechanism for the capsule is provided without a dedicated puncturing or piercing element necessary to pierce an inlet face of the capsule. Hence, even capsules made of a material which is hard to pierce such as plastics e.g., polypropylene plastics, can be opened easily.

In a preferred embodiment, the membrane is attached to the inlet face of the capsule by a second circumferential section, radially offset to the first circumferential section in a manner that channels between the second circumferential section and the inlet face are present or are produced when deflecting the membrane inwards.

Accordingly, pressure or a force being exerted on the membrane results in a deflection of the membrane inwards and hence towards the ingredients compartment of the capsule, in order to cause the first circumferential section to delaminate from the membrane and/or the inner side of the portion of the inlet face surrounding the aperture.

Preferably, the aperture formed in the inlet face of the capsule is circular. However, the aperture may as well be of another geometrical shape, e.g. rectangular or hexagonal shaped.

Furthermore, the first and the second circumferential sections are preferably forming a continuous ring-shaped closing portion surrounding the aperture.

The channels are designed to guide liquid injected through the aperture to the ingredients compartments of the capsule. This offers the possibility to tailor the injection mode respectively the injection pattern to the type of ingredients in the capsule and/or beverage to be produced. Hence, the versatility of the system is increased.

In a preferred embodiment, the second circumferential section comprises a plurality of non-delaminable segments which are fixedly connecting the membrane to the inner side of the portion of the inlet face surrounding the aperture.

Furthermore, the non-delaminable segments are preferably radially extending from the first circumferential section. Thereby, the channels are preferably formed by radially extending recesses of the first and second circumferential sections.

Hence, the delaminable portion of the first circumferential section forms a continuously closing portion provided at the inner side of the continuous ring-shaped closing portion surrounding the circular aperture. Moreover, the non-delaminable portions form a series of discontinuous non-closing portions, wherein the channels are present between the non-delaminable portions.

The delaminable and non-delaminable portions of the first circumferential section and the second circumferential section are arranged adjacent to one another.

In a preferred embodiment, the first circumferential section and thus the delaminable portion is a soft adhesive. Accordingly, the delamination portion is made of a relatively soft or weak adhesive that has sufficient strength to provide a gas tight seal of the capsule and the membrane covering the aperture.

The non-delaminable portions of the second circumferential section are preferably fixedly connecting the membrane and the inlet side of the capsule by adhesive or welding technique.

The non-sealed or non-delaminable portions are preferably distributed evenly at the circumference of the aperture of the capsule. Accordingly, liquid introduced through the aperture between the membrane and the body of the capsule can be distributed in the ingredients compartment of the capsule in a homogeneous manner.

Due to the channels formed in the second circumferential section, the risk of resurgence of beverage residues from the opened capsule, in particular the backflow through the pierced holes, such as of coffee grinds of liquids present in the ingredients compartment of the capsule, is minimized.

In addition, filter means are preferably provided within the channels of the second circumferential section in order to prevent residues from flowing back through the aperture on the inlet face of the capsule.

The filter means provided to the channels are preferably layered locally as a filter member having an annular portion arranged between the second circumferential section and the inner portion of the inlet face of the capsule. However, the filter member may as well be arranged largely on the inside surface of the capsule.

Moreover, the membrane and an inner side of the inlet face of the capsule body are superposed and designed to form a valve effect in the area of the liquid channels. Accordingly, the risk of resurgence of beverage residues from the opened capsule can be further reduced.

The ingredients compartment of the capsule and the membrane attached to the inlet face of the capsule are preferably made of plastics and/or metal such as aluminum for example.

It should be understood that the adhesive forming the first circumferential section may be provided with sufficient tackiness to reseal the aperture formed between the membrane and the aperture of the capsule such that the inner circumferential section may be reclosed by being reconnected to the inner side of the capsule and the membrane after a pressure of liquid being provided to an inlet side of the capsule is dropped.

In a second aspect, the present invention proposes a method for connecting a capsule comprising at least a rigid body having a circular aperture and a membrane for covering the aperture by a sealing engagement, the method comprising the steps of:

applying sealing means to an outer rim portion of the membrane, wherein the sealing means comprises a sealing member having a first circumferential and second circumferential portions arranged radially offset to each other and wherein the second circumferential portion comprises recesses extending radially from the first circumferential portion, and connecting the membrane to the inner side of the portion of the inlet face surrounding the aperture by the sealing means.

The method enables the provision of two different circumferential portions forming a partially detachable sealing between a capsule comprising an aperture to be covered and a dedicated membrane suitable for covering the aperture.

In a third aspect, the present invention proposes a system for preparing a beverage from a food substance contained in an ingredients compartment of a rigid capsule by injection of a liquid into the capsule, the system comprising a device which has at least one enclosing member connected to a closing mechanism for selectively enclosing the capsule in a receiving chamber of the device, the device further comprising a pump for supplying liquid to the capsule and liquid injection means for providing a liquid under pressure to a membrane covering an aperture provided at an inlet face of the capsule, wherein the membrane of the capsule is connected to an inner surface of the inlet face of the capsule by a circumferential section in a detachable sealing engagement, and wherein the detachable sealing engagement is designed to be disengaged from the capsule body or the membrane by means of the deflection of the membrane due to the effect of liquid under pressure being provided to the inlet side of the capsule.

Hence, when the capsule is provided to a dedicated receiving chamber of a beverage preparation device to be used in combination with the capsule, pressure provided to the receiving chamber and thus to the membrane provided at the inlet side of the capsule causes the membrane to deflect inwardly, i.e. towards the ingredients compartment of the capsule.

Hence, due to the inward movement of the membrane the continuous first circumferential section of the sealing engagement will delaminate and thus, a slot or preferably circular aperture is produced between the membrane and the inlet face of the capsule. The second circumferential section however comprising non-eliminable portions will resist the delamination, thereby forming channels suitable to guide liquid provided to the inlet face of the capsule towards the ingredients compartment between the non-eliminable segments of the second circumferential section. Accordingly, liquid being provided to the inlet face of the capsule is in enabled to enter the capsule's ingredients compartment in a radial outward direction.

BRIEF DESCRIPTION OF THE DRAWING FIGURES

Further features, and advantages and objects of the present invention will be come apparent for the skilled person when reading the following detailed description of the embodiments of the present invention, when taken in conjunction with the figures of the enclosed drawings.

FIG. 1*a* shows a preferred embodiment of the capsule body comprising a circular aperture at the inlet face of the capsule.

Figure 1B:
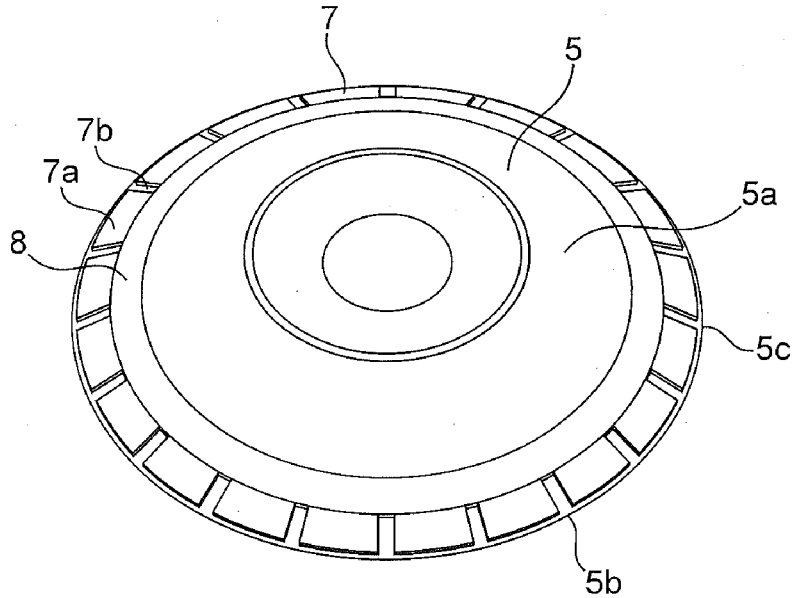

FIG. 1*b* shows a preferred embodiment of the membrane to be connected with the capsule in order to cover the aperture at the inlet face of the capsule.

Figure 2A:
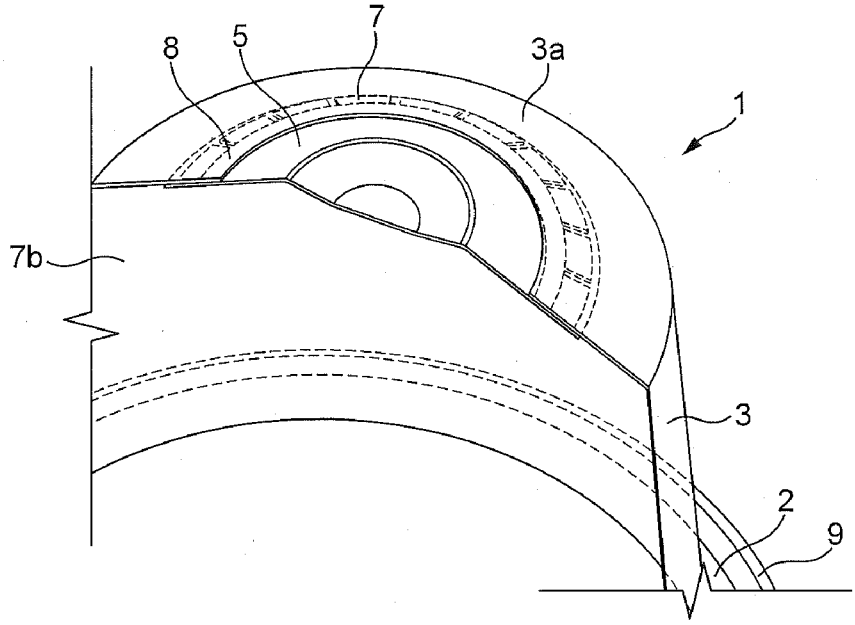

FIG. 2*a* shows a sectional side view of a preferred embodiment of the capsule, wherein the membrane is connected to an inner side of the portion of the inlet face surrounding the aperture.

Figure 2B:
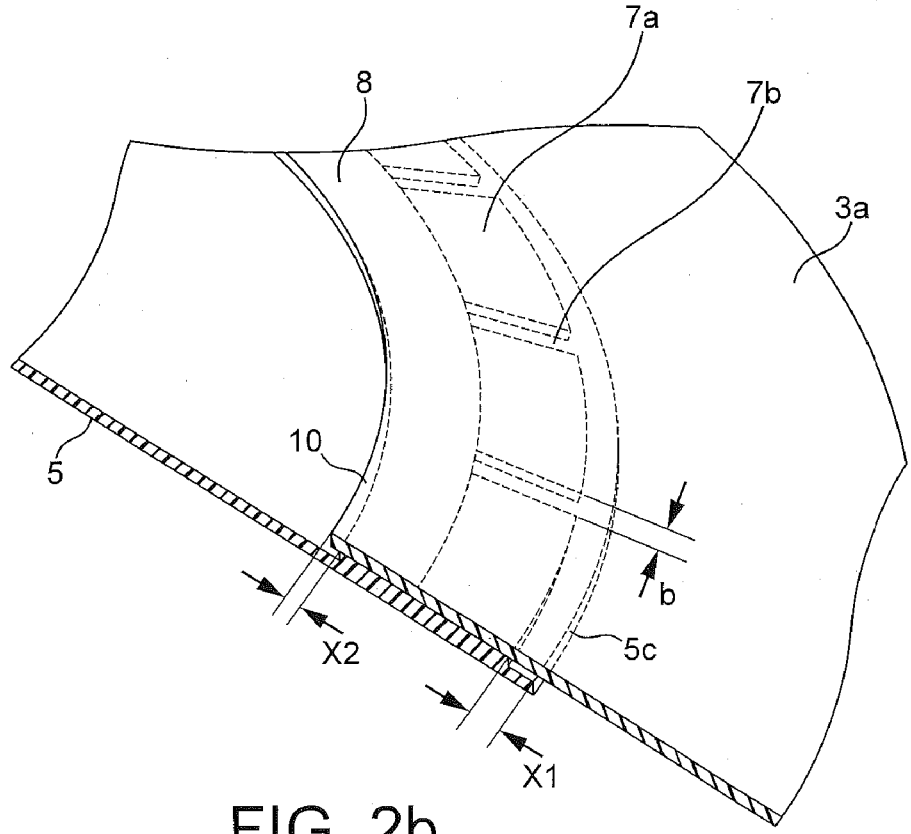

FIG. 2*b* shows an enlarged sectional side view of the embodiment of the capsule according to FIG. 2*a*.

Figure 3A:
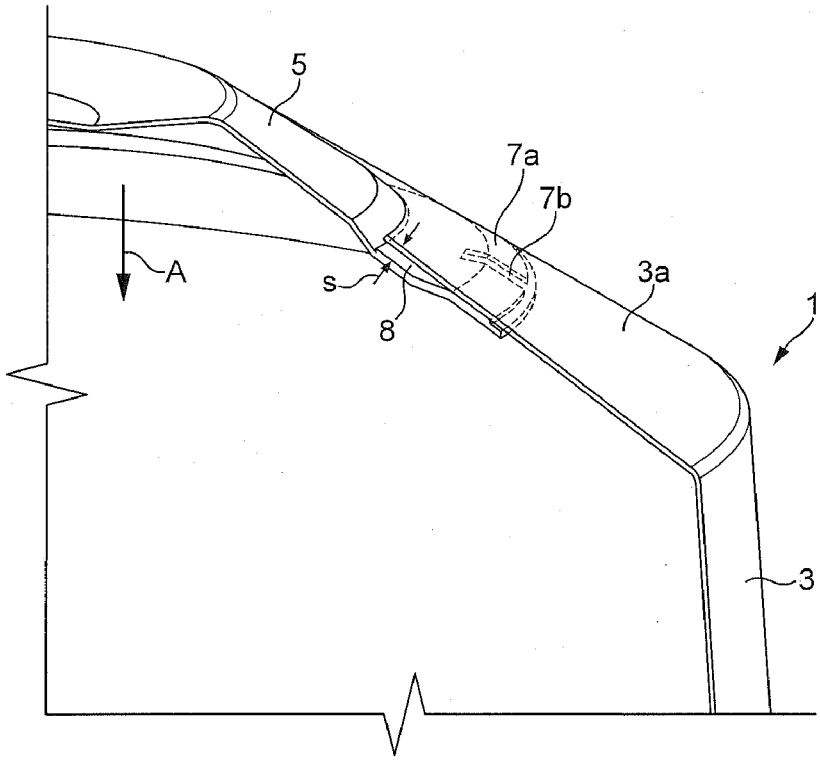

FIG. 3*a* shows the capsule according to the present invention in sectional side view, wherein the membrane is deflected inwards towards the ingredients compartment and the first circumferential section is delaminated from the inner side of the inlet face of the capsule.

Figure 3B:
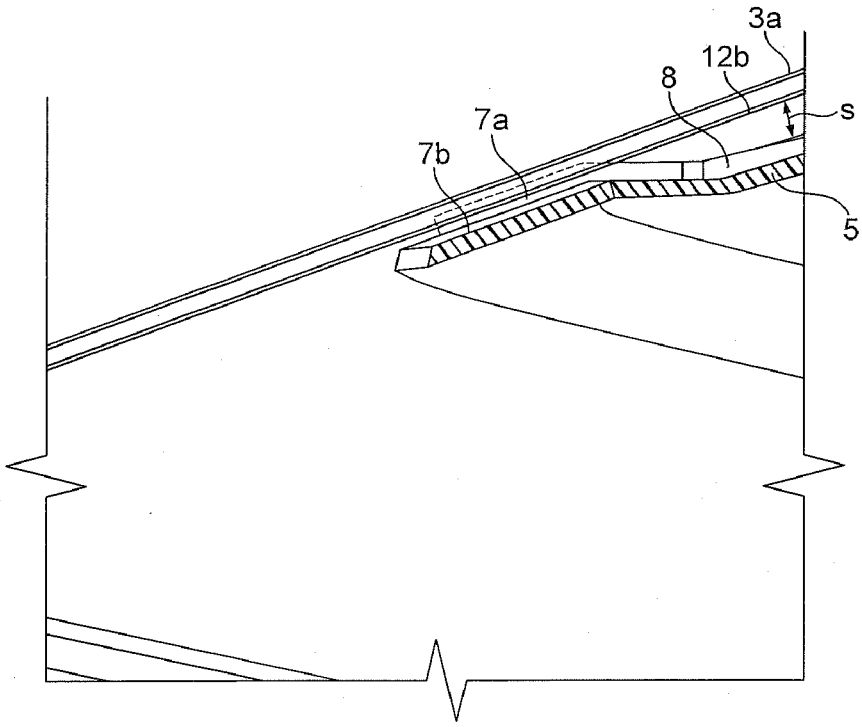

FIG. 3*b* shows an enlarged view of the capsule shown in FIG. 3*a*.

Figure 4A:
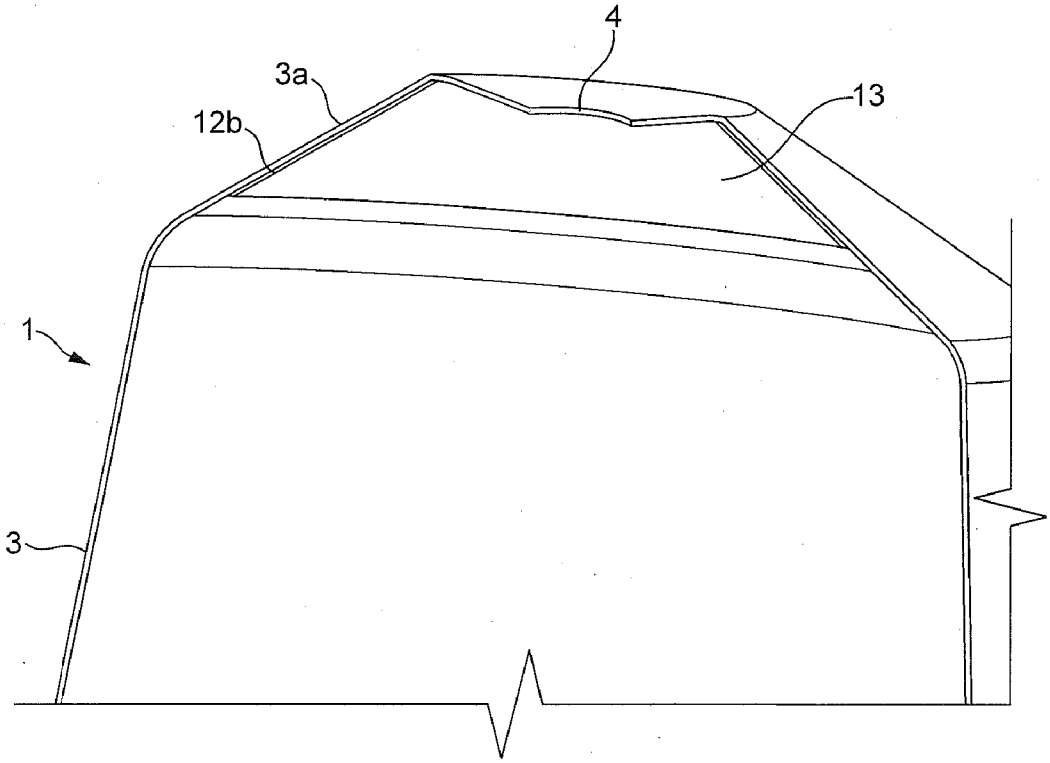

FIG. 4*a* shows another preferred embodiment of the capsule according to the invention, wherein a smaller aperture is provided in the inlet face of the capsule.

Figure 4B:
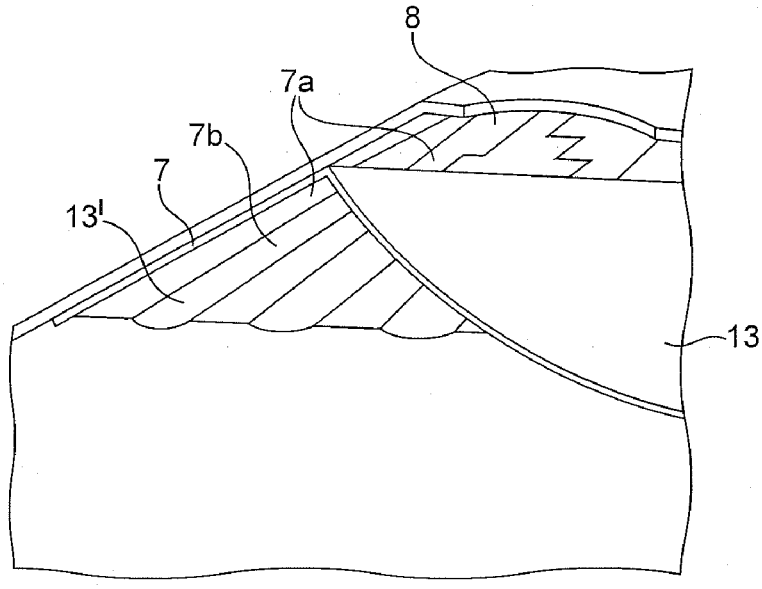

FIG. 4*b* shows the capsule according to FIG. 4*a*, wherein the sealing means provided at the inlet face of the capsule are shown in the delaminated state.

Figure 5:
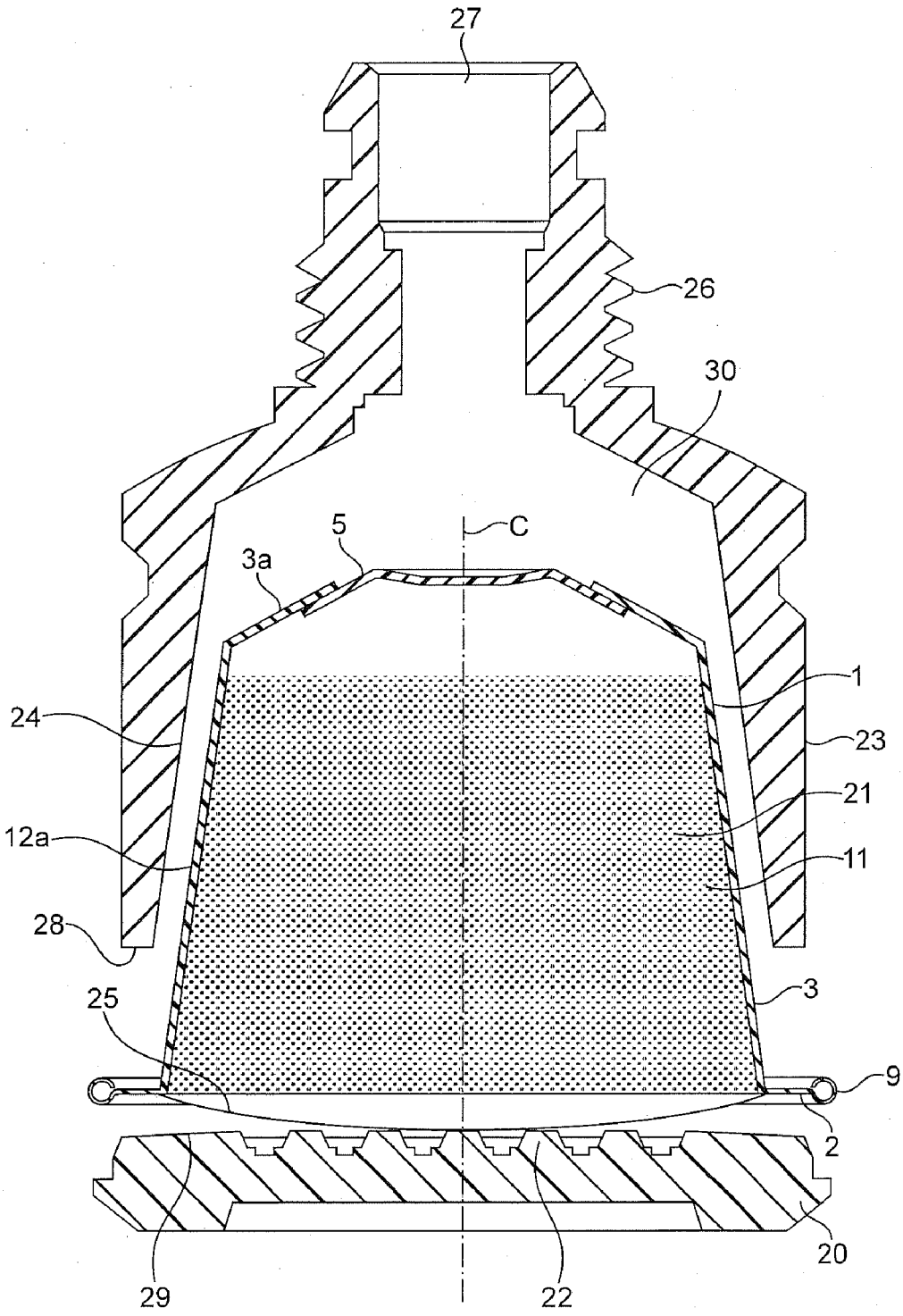

FIG. 5 shows a preferred embodiment of a system according to the present invention, wherein the capsule is enclosed by a dedicated bell-shaped enclosing member of the device.

DETAILED DESCRIPTION OF PREFERRED EMBODIMENTS

FIG. 1 shows a preferred embodiment of a capsule according to the present invention in perspective side view. The capsule 1 comprises a preferably frusto-conical body portion 3.

Moreover, the capsule 1 comprises an inlet face 3*a* which is provided with a preferably circular shaped aperture 4. It should be noted that the aperture 4 can be of any other geometrical shape such as e.g., a rectangular or hexagonal shape.

Furthermore, the capsule 1 comprises an outlet face 3*b* at which a flange-like rim portion 2 is connected to the body portion 3 of the capsule. Thereby, the flange-like rim portion 2 is preferably orientated perpendicular to a central axis c (see FIG. 5) of the capsule 1.

The capsule body portion 3 is preferably an integral part made of metal such as aluminium. In another preferred embodiment, the body portion 3 of the capsule is made of plastic, e.g., polypropylene plastics. The shown embodiment of the capsule 1 is preferably obtained by a deep drawing process or by injection moulding.

The capsule comprises an outer surface 12*a* and an inner surface 12*b*.

At the end portion 9 of the flange-like rim portion 2, a curled portion is preferably formed and hence, no sharp edges are protruding from the capsule at the flange-like rim portion 2. Accordingly, a user is prevented from cutting himself when handling the capsule 1.

FIG. 1*b* shows a preferred embodiment of the membrane 5 to be connected to the capsule 1 in order to cover the aperture 4. The membrane 5 is preferably a disc shaped membrane made of aluminum or plastics.

At the circumference of the membrane 5, a first circumferential section 8 is applied to an upper surface 5*a* of the membrane 5. Please note that the lower surface 5*b* of the disc-shaped membrane faces the interior of the capsule 1 when the membrane 5 is connected to the capsule body portion 3. It is to be noted that the membrane 5 can be of any geometrical shape suitable for covering the aperture 4 formed in the capsule 1. The first circumferential section 8 is preferably applied to the membrane 5 in a ring-shaped arrangement being offset from the outer circumferential edge 5*c* of the membrane 5.

Between the first circumferential section 8 and the outer edge 5*c* of the membrane 5, a second circumferential section 7 is preferably applied to the upper surface 5*a* of the membrane 5. The second circumferential section 7 preferably comprises a plurality of segments 7*a* which are extending radially from the first circumferential section 8 towards the outer circumferential edge 5*c* of the membrane 5. It should be noted that the first circumferential section 8 may be radially offset from the second circumferential section 7 to a certain extent, i.e., a ring-shaped space may be provided between the first and the second circumferential sections 7,8.

Between the radially extending section 7*a*, fluid channels 7*b* are formed due to the fact that no sealing material is applied thereto.

The first and the second circumferential sections 7,8 are preferably made of sealing material applied to the upper surface 5*a* of the membrane 5.

The first and the second circumferential sections 7, 8 are preferably of different sealing material. In a preferred embodiment, the first circumferential section 8 is a soft or relatively weak adhesive suitable for forming a gas-tight sealing between the membrane 5 and the capsule body portion 3 when the membrane 5 is connected to the inlet face 3*a* of the capsule 1.

The segments 7*a* of the second circumferential section are preferably formed by application of a relatively stronger adhesive or sealing material than the first circumferential section 8. Hence, when the membrane 5 is connected to the inner side 12*b* of the portion of the inlet face 3*a* surrounding the aperture by means of the sealing engagement of the first and the second circumferential section 7, 8, the connection of the membrane 5 to the inlet face 3*a* formed by the segment 7*a* is of a higher resistance to a given intensity of load than the connection of the membrane 5 to the inlet face 3*a* due to the adhesive connection formed by the first circumferential section 8.

It is to be noted that the non-delaminable segments 7*a* of the second circumferential section 7 may as well be connecting the membrane 5 and the inlet face 3 of the capsule by means of welding or other joining or securing techniques.

FIG. 2*a* shows a sectional side view of the capsule 1, wherein the membrane 5 is connected to the inlet face 3*a* of the capsule body portion 3. Accordingly, a gas tight sealing between the inlet face 3*a* of the capsule body portion 3 and the membrane 5 is obtained by the sealing engagement due to the first circumferential section applied to the membrane 5.

As can be seen in FIG. 2*b*, the first and the second circumferential sections 7, 8 form a circular sealing engagement between the membrane 5 and the inlet face 3*a* of the body portion 3 of the capsule 1. Thereby, the segments 7*a* are preferably distanced at a predefined distance t1 from the edge 5*c* of the membrane 5.

Moreover, the segments 7*a* are preferably distanced from each other by a predefined distance b which preferably is within the range of 0.1 to 15 mm. Accordingly, channels 7*b* are formed between the segments 7*a* and the upper surface 5*a* of the membrane 5 and the inner surface 7*b* of the inlet face 3*a* of the capsule body portion 3. Thereby, the channels 7*b* as shown in FIG. 2*b* are preferably radially arranged and thus, are preferably linear. However, the channels 7*b* may be of any geometrical shape. For example, the distance b between the segments 7*a* forming the channels 7*b* may be radially increasing or decreasing in order to vary the injection pattern into the capsule 1.

The first circumferential section 8 of the sealing engagement is preferably applied to the membrane 5 such that the first circumferential section 8 is offset from the edge 10 of the aperture 4 at a predefined distance t2 as indicated in FIG. 2*b*. Hence, the edge 10 of the aperture 4 is protruding to a predefined extent towards the central axis c of the capsule 1.

FIGS. 3*a* and 3*b* show a preferred embodiment of the capsule 1, wherein a force such as pressure is applied to the inlet face 3*a* and thus to the membrane 5. Due to such a force being applied, the membrane 5 deflects inwardly as indicated by arrow A, i.e. towards the inside of the body portion 3 of the capsule. The force being applied to the membrane 5 can be due to a mechanical or physical pushing means being provided at a dedicated beverage preparation device to be used with the capsule 1. However, in a preferred embodiment, the force necessary to cause the membrane 5 to flex inwardly is due to water under pressure being applied to the inlet face 3*a* and thus to the membrane 5 of the capsule 1.

Due to the motion of the membrane 5, the first circumferential section 8 is delaminated from either the inner surface 12*b* of the inlet face 3*a* of the capsule and/or the upper surface 5*a* of the membrane 5. Hence, a circumferential slot or aperture S is established between the upper surface 5*a* of the membrane 5 and the inner surface 12*b* of the inlet face 3*a*. Hence, a fluid connection between the circular slot or aperture S and the channels 7*b* formed between the segments 7*a* of the second circumferential section 7 is established. Therefore, liquid provided to the slot or aperture S can be distributed via the channels 7*b* to the inside of the capsule body portion 3.

FIG. 4*a* shows another preferred embodiment of the capsule 1 according to the present invention, wherein a small aperture 4 is provided at the inlet face of the capsule 3*a* which is covered from the inside by a membrane 13 which is preferably of aluminium. Thereby, the membrane 13 is sealed to the inner surface 12*b* of the inlet portion 3*a* by a first circumferential section 8 (see FIG. 4*b*) and a second circumferential section 7 which comprises non-delaminable segments 7*a* extending radially from the first circumferential section 8.

Hence, when the membrane 13 is connected to the inlet side of the inlet face 3*a* of the capsule 1 by the first and circumferential sections 8 an air-tight sealing of the capsule 1 respectively of the aperture 4 formed in the capsule 1 is obtained.

However, when pressure is exerted to the aperture 4, the membrane 13 deflects as shown in FIG. 4*b* and thus, the first circumferential section 8 is delaminated. However, the non-delaminable segments 7*a* are fixedly connecting the membrane 13 to the inner surface 12*b* of the inlet face 3*a* of the capsule. Thereby, channels 7*b* are formed due to the pressure being exerted onto the membrane 13, which channels 7*b* enable a fluid connection between the aperture 4 and the inside of the body portion 3 of the capsule 1.

FIG. 5 shows a capsule 1 according to the present invention which has been placed into a beverage production device to be used with the capsule. Thereby, the interior of the capsule 1 has been filled with portioned ingredients 21 and the capsule 1 has been sealed by means of a foil member 25. Thereby, the foil member 25 is sealed to the flange-like rim portion 2 to hermetically seal the body portion 3 of the capsule 1.

Ingredients 21 within the capsule 1 are selected such that a beverage can be produced when having a liquid entering the capsule in the region of the aperture 4 of the capsule 1 and then interact with such ingredients. Preferred ingredients are e.g. ground coffee, tea or any other ingredients from which a beverage or other liquid or viscous comestible (e.g. soup) can be produced.

Note that the foil member 25 is shown as not exactly flat due to a defined overpressure inside the capsule, which overpressure is generated by introducing e.g. a protective gas when producing the filled capsule 1.

A capsule holder 20 of the beverage production device is preferably equipped with relief elements 22 which are designed to tear and perforate the foil member 25 of the capsule 1. This tearing of the foil member can e.g. occur as soon as the pressure inside the capsule exceeds a threshold value. Note that the relief elements 22 can have any protruding shape able to cause a (partial) tearing of the foil member 25. As an example only pyramids, needles, bumps, cylinders, elongated rips are cited.

As shown in FIG. 5, the capsule 1 placed on a capsule holder 20 of the beverage production device, the foil member 25 resting on the relief element 22 side of the capsule holder 20 and the base body portion 3 of the capsule 1 being already partly surrounded by the circumferential wall 24 of an enclosing member 23 of the beverage production device. A shown enclosing member 23 has the shape of a bell. However, other shapes are viable, wherein the design of the interior contours (recess) of the enclosing member 23 is generally adapted to substantially match the contours of the capsule 1.

It should be noted that the shown thread 26 is just an example for connecting means and therefore, any other releasable or permanent connection means may be used to connect the enclosing member 23 to a beverage production device.

The beverage preparation device according to the present invention comprises a pump connected to a water or liquid reservoir and a water heater connected to the water inlet opening 27 such that hot water under pressure can be provided to the enclosing member 23.

The other components of the beverage production device, such as e.g. the mechanism for displacing the enclosing member 23 and eventually also the capsule holder 20 are known from the prior art in the field of capsule based espresso machines.

Before the injection of water to the interior 30 of the enclosing member 23, the enclosing member 23 is lowered such that the bottom portion 28 presses the outer rim portion 2 of the capsule 1 towards the upper surface 29 of the capsule holder 20. Accordingly, the capsule 1 is enclosed by the enclosing member and the capsule holder 20 in a sealed manner.

After enclosing the capsule 1, liquid is provided by liquid injection means of the device, i.e. by the pump and the liquid reservoir of the device to the water inlet opening 27 and hence to the interior 30 of the enclosing member 23. Accordingly, pressure is built up between the inner wall 24 of the enclosing member 23 and the outer surface 12*a* of the capsule 1. Hence, due to the pressure provided in the interior of the enclosing member 23, the membrane 5 will flex down due to the pressure being exerted on the inlet face 3*a* of the capsule 1. Thus, the first circumferential section 8 will delaminate and a fluid connection between the inlet opening 27 respectively the interior of the enclosing member 23 and the capsule ingredients compartment 11 within the capsule 1 is formed by means of the channels 7*b* arranged between the non-delaminable segments 7*a* of the second circumferential section 7.

Due to the water being injected into the ingredients compartment 11 of the capsule 1, pressure builds up inside the capsule and causes the foil member 25 to be pressed against the relief members 23 and thus, openings are produced in the foil member 25 of the capsule 1.

Accordingly, when a sufficient pressure of water has been built up inside the capsule 1, the beverage produced due to an interaction between the injected water and the portion ingredients 21 housed within the capsule 1 can be drained in small interstices between the relief members 22 and the surrounding foil member 25.

It should be noted that after the beverage preparation, the enclosing member 23 can be brought into an open state in order to release the capsule from the engagement. Thereby, due to the valve-effect of the first and second circumferential sections 7,8, resurgence from residues from the ingredients compartment 11 flowing back through the channels 7*b* at the inlet face 3*a* of the capsule is effectively prevented.

Moreover, conventional filter means or filter elements (not shown) may be arranged at the channels 7*b* in order to effectively prevent any residues from escaping the capsule 1 at the inlet face 3*a*.

Furthermore, the first circumferential section 8 may have sufficient tackiness in order to reclose the aperture 4 after the liquid provision to the inlet face 3*a* of the capsule 1 has stopped and hence, reseal the inlet face 3*a* of the capsule 1, thereby further preventing any residues from escaping the capsule 1 at the inlet face 3*a*.

Although the present invention has been described with reference to preferred embodiments thereof, many modifications and alternations may be made by a person having ordinary skill in the art without departing from the scope of this invention which is defined by the appended claims.

What is claimed is:

1. A capsule for containing beverage ingredients, for the preparation of a beverage by injection of a liquid into the capsule, comprising:

a sealed ingredient compartment containing beverage ingredients;

an inlet face having outer and inner sides and dedicated for injection of liquid into the capsule to form a beverage from the beverage ingredients;

an outlet face dedicated for the delivery of the beverage;

an aperture in the inlet face of the capsule;

a membrane attached to a portion of the inner side of inlet face which surrounds the aperture, wherein the membrane is attached to the inlet face portion by a first circumferential section in detachable sealing engagement therewith; and a second circumferential section, radially offset from the first circumferential section, for attaching the membrane to the inner side of the inlet face of the capsule in a manner that presents channels between the second circumferential section and the inlet face when deflecting the membrane, wherein the channels guide liquid injected into the aperture to the ingredients compartment of the capsule.

2. The capsule according to claim 1, wherein the aperture in the inlet face of the capsule is circular.

3. The capsule according to claim 2, wherein the first circumferential section forms a continuous ring-shaped closing portion surrounding the circular aperture.

4. The capsule according to claim 1, wherein the first circumferential section is delaminable from the membrane or the inner side of the portion of the inlet face surrounding the aperture.

5. The capsule according to claim 1, wherein the second circumferential section comprises a plurality of non-delaminable segments which are fixedly connecting the membrane to the inner side of the portion of the inlet face surrounding the aperture.

6. The capsule according to claim 5, wherein the non-delaminable segments radially extend from the first circumferential section.

7. The capsule according to claim 1, wherein the channels are formed by radially recesses extending from the second circumferential section toward the first circumferential section.

8. The capsule according to claim 1, wherein the first circumferential section is a relatively soft or weak adhesive that has sufficient strength to form a gas tight seal.

9. The capsule according to claim 8, which further comprises a second, circumferential section, radially offset from the first circumferential section, for attaching the membrane to the inner side of the inlet face of the capsule, wherein the second circumferential section is formed by a relatively stronger adhesive or sealing material than the first circumferential section.

10. The capsule according to claim 1, which further comprises a filter within the channels.

11. A capsule for containing beverage ingredients, for the preparation of a beverage by injection of a liquid into the capsule, comprising:

a sealed ingredient compartment containing beverage ingredients:

an inlet face having outer and inner sides and dedicated for injection of liquid into the capsule to form a beverage from the beverage ingredients;

an outlet face dedicated for the delivery of the beverage:

an aperture in the inlet face of the capsule; and a membrane attached to a portion of the inner side of inlet face which surrounds the aperture wherein the membrane is attached to the inlet face portion by a first circumferential section in detachable sealing engagement therewith;

wherein the membrane and an inner side of the inlet face of the capsule body are superposed and designed to form a non-return valve in the area of the liquid injection passages.

12. The capsule according to claim 11, wherein the ingredients compartment of the capsule and the membrane attached to the inlet face of the capsule are made of plastics or aluminum.

13. The capsule according to claim 11, wherein the first circumferential section is delaminable from the membrane or the inner side of the portion of the inlet face surrounding the aperture.

14. A system for preparing a beverage from a food substance contained in the ingredients compartment of a capsule by injection of a liquid therein, the capsule comprising:

a sealed ingredient compartment containing beverage ingredients;

an inlet face having outer and inner sides and dedicated for injection of liquid into the capsule to form a beverage from the beverage ingredients;

an outlet face dedicated for the delivery of the beverage;

an aperture in the inlet face of the capsule;

a membrane attached to a portion of the inner side of inlet face which surrounds the aperture, wherein the membrane is attached to the inlet face portion by a first circumferential section in detachable sealing engagement therewith, and the system comprising:

a device which has at least one enclosing member connected to a closing mechanism for selectively enclosing the capsule in a receiving chamber of the device, a pump for supplying liquid to the capsule, and liquid injection means for providing a liquid under pressure to the membrane covering the capsule aperture at an inlet face thereof, wherein the detachable sealing engagement is designed to be disengaged from the capsule body or the membrane by deflection of the membrane due to the effect of a pressure being provided to the inlet side of the capsule.

15. The system according to claim 14, wherein the first circumferential section of the capsule is delaminable from the membrane or the inner side of the portion of the inlet face surrounding the aperture.

16. The system according to claim 14, wherein the capsule further comprises a second circumferential section, radially offset from the first circumferential section, for attaching the membrane to the inner side of the inlet face of the capsule in a manner that presents channels between the second circumferential section and the inlet face when deflecting the membrane, wherein the channels guide liquid injected into the aperture to the ingredients compartment of the capsule.

17. The system according to claim 16, wherein the second circumferential section of the capsule comprises a plurality of non-delaminable segments which are fixedly connecting the membrane to the inner side of the portion of the inlet face surrounding the aperture.

18. A system for preparing a beverage from a food substance contained in a ingredients compartment of a rigid capsule by injection of a liquid into the capsule, the system comprising:

a device which has at least one enclosing member connected to a closing mechanism for selectively enclosing the capsule in a receiving chamber of the device, a pump for supplying liquid to the capsule, and liquid injection means for providing a liquid under pressure to a membrane covering an aperture provided at an inlet face of the capsule, wherein the membrane of the capsule is connected to an inner surface of the inlet face of the capsule by at least one circumferential section that is in detachable sealing engagement, wherein the detachable sealing engagement is designed to be disengaged from the capsule body or the membrane by deflection of the membrane due to the effect of a pressure being provided to the inlet side of the capsule.

19. A method for connecting a capsule comprising at least a rigid body having a circular aperture and a membrane for covering the aperture by means of a sealing engagement, which method comprises:

applying sealing means to an outer rim portion of the membrane, wherein the sealing means comprise a first circumferential portion and a second circumferential portion being arranged radially offset to each other and wherein the second circumferential portion comprises recesses extending radially from the first circumferential portion, and connecting the membrane to the inner side of the portion of the inlet face surrounding the aperture by the sealing means.

* * * * *

UNITED STATES PATENT AND TRADEMARK OFFICE

CERTIFICATE OF CORRECTION

PATENT NO. : 8,402,883 B2
APPLICATION NO. : 12/689896
DATED : March 26, 2013
INVENTOR(S) : Kollep et al.

It is certified that error appears in the above-identified patent and that said Letters Patent is hereby corrected as shown below:

In the Claims:

Column 10:
Line 24 (claim 9, line 2), change “second,” to -- second --.
Line 36 (claim 11, line 5), change “ingredients:” to -- ingredients; --.
Line 40 (claim 11, line 9), change “beverage:” to -- beverage; --.

Signed and Sealed this
Fourteenth Day of May, 2013

Teresa Stanek Rea
*Acting Director of the United States Patent and Trademark Office*